US005529042A

United States Patent [19]

Augustin et al.

[11] Patent Number: 5,529,042

[45] Date of Patent: Jun. 25, 1996

[54] FUEL INJECTION SYSTEM FOR AN INTERNAL COMBUSTION ENGINE

[75] Inventors: Ulrich Augustin, Kernen; Hermann Hiereth, Esslingen, both of Germany

[73] Assignee: Mercedes-Benz A.G., Stuttgart, Germany

[21] Appl. No.: 387,197

[22] Filed: Feb. 13, 1995

[30] Foreign Application Priority Data

Mar. 4, 1994 [DE] Germany ..... 44 07 166.3

[51] Int. Cl.[6] ..... F02M 37/04

[52] U.S. Cl. ..... 123/456; 123/506

[58] Field of Search ..... 123/456, 506, 123/514, 458, 446

[56] References Cited

U.S. PATENT DOCUMENTS

| | | | |
|---|---|---|---|
| 5,058,553 | 10/1991 | Kondo | 123/456 |
| 5,197,439 | 3/1993 | Gronenberg | 123/506 |
| 5,230,613 | 7/1993 | Hilbos . | |
| 5,277,156 | 1/1994 | Osuka | 193/456 |
| 5,377,636 | 1/1995 | Rix | 123/506 |
| 5,404,855 | 4/1995 | Yen | 123/456 |

FOREIGN PATENT DOCUMENTS

| | | |
|---|---|---|
| 0243871 | 11/1987 | European Pat. Off. . |
| 593161 | 1/1984 | Japan . |
| 1572061 | 7/1980 | United Kingdom . |

OTHER PUBLICATIONS

ATZ/MTZ Sonde–heft Motor und Umwelt92, "Electronic controlled Fuel Injection System for Clean Diesel Engine" by Toshihiko Omori.

*Primary Examiner*—Carl S. Miller
*Attorney, Agent, or Firm*—Klaus Bach

[57] ABSTRACT

In a fuel injection system for an internal combustion engine with solenoid valve controlled fuel injection nozzles receiving fuel from a common high pressure fuel supply line to which fuel is supplied via a high-pressure line including a check valve by a mechanically operated high pressure piston pump which has a piston disposed in a cylinder to which fuel is fed by a low pressure fuel supply line, a control line extends between the high-pressure line upstream of the check valve and the fuel supply line and includes a solenoid valve to permit fuel discharge from the pump back to the fuel supply line and a bypass line extends between the high-pressure line downstream of the check valve and the cylinder to provide communication with the fuel supply line through passages in the piston and the working space of the piston when the piston is in its inserted position and the solenoid is open to permit the release of pressurized fuel from the common high-pressure fuel supply line to the low pressure fuel supply line.

4 Claims, 2 Drawing Sheets

FUEL INJECTION SYSTEM FOR AN INTERNAL COMBUSTION ENGINE

BACKGROUND OF THE INVENTION

The invention relates to a fuel injection system for an internal combustion engine, in which a mechanically operated high-pressure pump feeds fuel into a common supply line (common rail) which is provided for solenoid valve-controlled injection nozzles and acts as a pressure accumulator.

A high-pressure pump which feeds fuel into a high-pressure accumulator is known from the ATZ/MTZ special publication Motor und Umwelt (Engine and Environment) 1992, page 28 et. seq. "Fuel Injection for Diesel", Toshihiko. A feed line is connected in the fuel filling phase to the pump working space from which a high-pressure line leads to the high-pressure accumulator with the intermediate connection of a non-return valve. A control line which branches off from the feed line and opens into the high-pressure line downstream of the non-return valve, contains a solenoid valve which can be opened as a function of operating parameters of the internal combustion engine and influences demand-controlled feeding of the fuel. A similar high-pressure pump is known from EP-O 243 871 A2 in which fuel is also fed via a non-return valve into a high-pressure accumulator and which also includes a control line branching off a high-pressure line and switchable by means of a solenoid valve disposed in the control line.

In the Patents Abstracts of Japan 59-3161, a line arrangement is disclosed with a branch which is in communication with the high-pressure line and has a control element for demand control and a further branch line. It has a pressure regulation valve which controls the maximum fuel pressure and via which the fuel can only flow out into the fuel supply space. This arrangement does include a common high-pressure accumulator or supply line for all the injection nozzles but is not adapted to accommodate rapid pressure changes in the common supply line in the case of rapid changes in load and r.p.m.

It is the object of the invention to provide a fuel injection system which requires little constructional outlay and which, when rapid changes in r.pm. and/or load occur, permits a rapid change in the pressure in the common supply line of the injection nozzles, adapted to the new operating state.

SUMMARY OF THE INVENTION

In a fuel injection system for an internal combustion engine with solenoid valve controlled fuel injection nozzles receiving fuel from a common fuel supply line to which fuel is supplied via a high-pressure line including a check valve by a mechanically operated high pressure piston pump which has a piston disposed in a cylinder to which fuel is fed by a low pressure fuel supply line, a control line extends between the high-pressure line upstream of the check valve and the fuel supply line and includes a solenoid valve to permit fuel discharge from the pump back to the fuel supply line and a bypass line extends between the high-pressure line downstream of the check valve and the cylinder to provide communication with the fuel supply line through passages in the piston and the working space of the piston when the piston is in its inserted position and the solenoid is open to permit the release of pressurized fuel from the high-pressure common fuel supply line to the low pressure fuel supply line.

By virtue of the particular arrangement of a bypass line and of flow passages in the pump piston of the high-pressure pump, it is possible to connect the high-pressure accumulator to the low pressure-side feed line via the bypass line which bypasses the non-return valve in the high-pressure line, via the flow passages in the piston and via the control line. Thus, when changes occur, e.g. in the case of a spontaneous load change from full load to idling, a rapid reduction in pressure in the high-pressure line and in the accumulator from a $\text{pressure}_{max}$ corresponding to the full load pressure to a $\text{pressure}_{min}$ corresponding to the idling pressure can be realized.

The arrangement of an additional solenoid valve is dispensed with since the solenoid valve which is present in the control line in any case and which usually adjusts for demand-controlled feeding of the fuel simultaneously has the function of controlling the outflow of fuel from the common supply line.

DESCRIPTION OF THE PREFERRED EMBODIMENT

Figure 1:
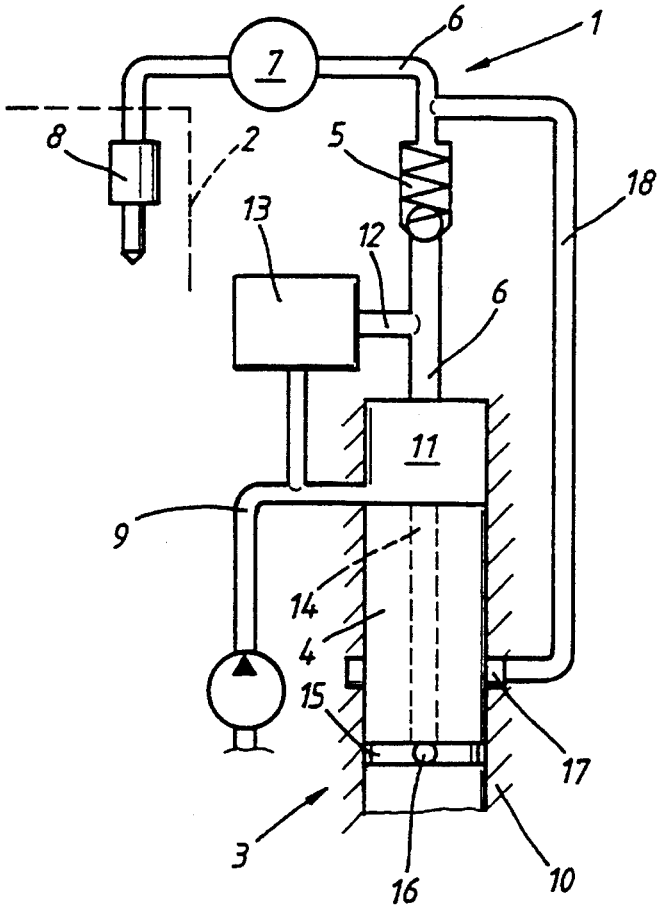
FIG. 1 shows part of a fuel injection system with a high-pressure pump and a high-pressure line which leads to a high-pressure accumulator and has a bypass line.

A fuel injection system 1 according to FIG. 1 for a multi-cylinder internal combustion Diesel engine 2 consists essentially of a cam-operated high-pressure pump 3 with a pump piston 4 which feeds fuel via a high-pressure line 6 equipped with a non-return valve 5 into a common supply line (common rail), acting as a high-pressure accumulator, for all the solenoid valve-controlled injection nozzles 8.

A low-pressure-side fuel feed line 9 opens into a pump working space 11 which is bounded by the pump piston 4 and pump cylinder 10. A control line 12 extends between the fuel feed line 9 and the high-pressure line 6 and is connected thereto downstream of the non-return valve 5. It contains a solenoid valve 13 which can be actuated as a function of operating parameters by an electronic control device (not illustrated in greater detail).

The pump piston 4 has a flow connection which consists of an axial passage 14 which opens into the pump working space 11, of a circumferential groove 15 and of a radial passage 16 which interconnects the axial passage 14 and the circumferential groove 15. In the pump cylinder 10 there is an annular groove 17 which interacts with the flow connection and which by a bypass line 18 is in communication with the high-pressure line 6 and which bypasses the non-return valve 5.

Figure 2:
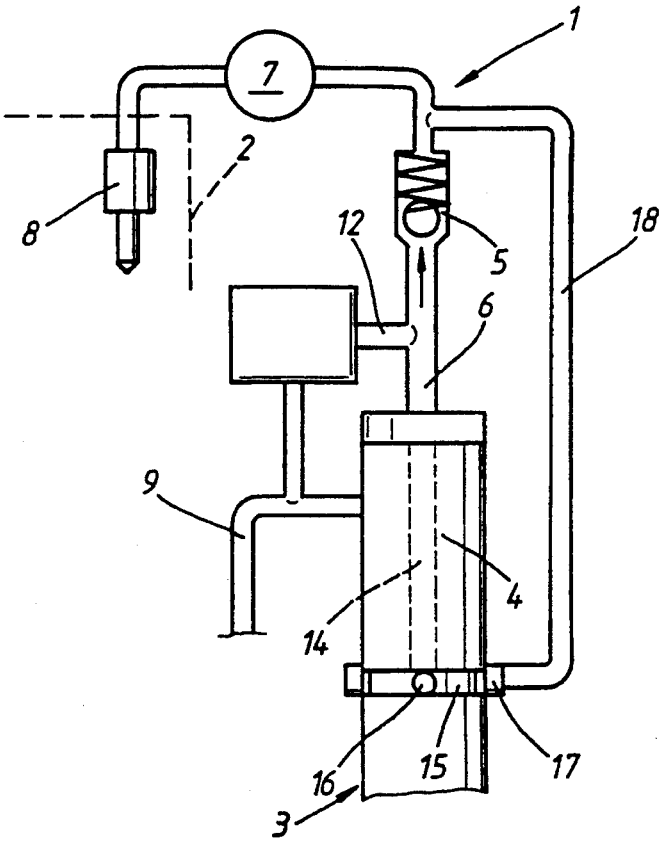
FIGS. 2 and 3 show the arrangement with the pump piston in various positions in which it interacts with the bypass line and the solenoid valve.
Figure 3:
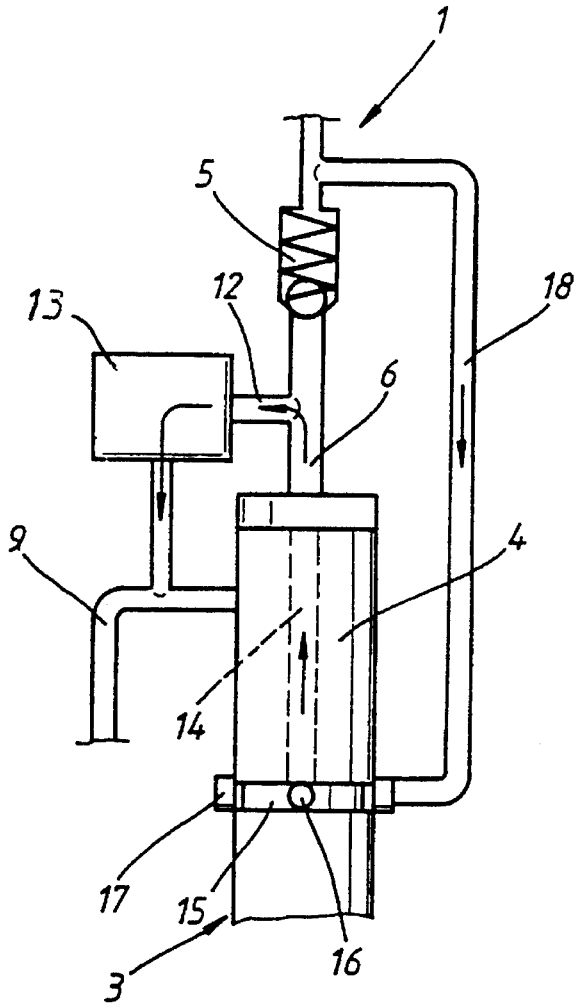

In FIG. 1, the pump piston 4 is shown in its lower position with the solenoid valve 13 closed, and thus the control line 12 blocked. The feed line 9 is opened. As soon as the pump piston 4, upon upward movement, closes the feed line 9 after the fuel filling phase, according to FIG. 2, fuel is fed into the supply line 7 via the non-return valve 5, which is opened thereby. In case there is no need to change the demand for fuel, the solenoid valve 13 continues to be closed. In the top position of the pump piston 4, the grooves 15 and 17 are disposed adjacent to one another such that a communication path is established from the high pressure line 6 downstream of the non-return valve 5 through the bypass line 18 and the flow passages 14, 16 in the pump piston 4. If the solenoid valve 13 is open in this travel phase, the fuel pressure in the supply line 7 is quickly reduced via the bypass 18, the flow connection and the control line 12 to the low-pressure side (FIG. 3).

Figure 4:
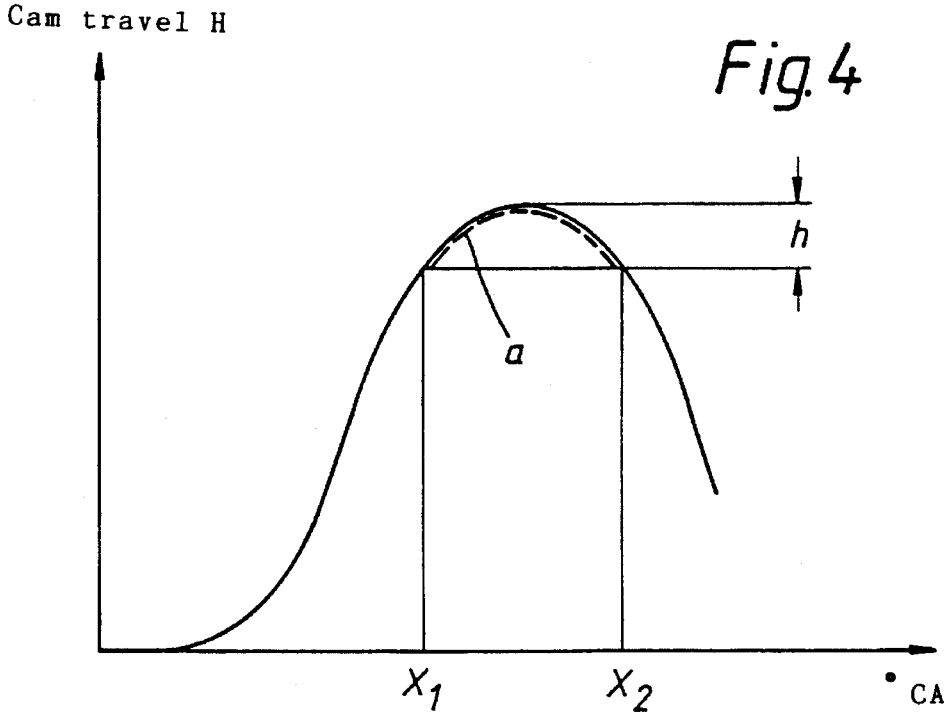
FIG. 4 is a graphical representation of the cam travel plotted against degrees of cam angle with a defined outflow range.

In FIG. 4, the cam travel "H" is shown over degrees of cam shaft angle "CA" with the piston travel "h" indicated by the rising and falling curve portion during which time the solenoid valve may be open. This indicates that the fuel return flow can start when the solenoid valve 13 opens at the point $x_1$ just before the top end position of the piston 4. The outflow is terminated when the solenoid valve 13 closes at the point $x_2$ just after the piston leaves the top end position.

The duration of outflow or the outflow phase is indicated by a broken illustrative line "a" but this duration can be varied in accordance with operating demands by appropriately actuating the solenoid valve, e.g. as a function of r.p.m. and/or load of the internal combustion engine.

In this manner the fuel pressure in the common high pressure fuel line 7 can be rapidly reduced to engine idle requirements under control of the solenoid valve 13 which is normally used to control the fuel supply to the common high pressure fuel supply line 7.

What is claimed is:

1. A fuel injection system for an internal combustion engine with solenoid-valve controlled fuel injection nozzles receiving fuel from a common high pressure fuel supply line, said fuel injection system comprising a mechanically operated high-pressure pump connected to said common high pressure fuel supply line by way of a high-pressure line including a check valve for supplying fuel under pressure to said common high pressure fuel supply line, said high-pressure pump having a pump piston disposed in a cylinder and defining therewith a pump working space, a low-pressure fuel feed line in communication with said pump working space for feeding fuel thereto when said pump piston is in a retracted position, a control line extending between said high-pressure line upstream of said check valve and said fuel supply line and including a solenoid valve to permit the discharge of fuel from said pump back to said fuel supply line when the pressure in said common high-pressure fuel supply line is sufficient, and a bypass line providing communication between said high-pressure line downstream of said check valve and said fuel supply line via flow passages formed in said piston and through said piston working space when the piston is in an inserted position and said solenoid valve is open to permit the release of pressurized fuel from said common high-pressure fuel supply line to said fuel supply line.

2. A fuel injection system according to claim 1, wherein said fuel bypass line and the passages formed in said piston are arranged such that communication is established only in the inserted position of the piston.

3. A fuel injection system according to claim 2, wherein said flow passages in the pump piston comprise a circumferential groove, an axial passage in said piston in communication with the pump working space and a radial passage interconnecting said axial passage and said circumferential groove, said circumferential groove interacting with said bypass line for the discharge of fuel from said common high pressure fuel supply line.

4. A fuel injection system according to claim 2, wherein, for the release of fuel from said common high-pressure fuel supply line, said solenoid valve is adapted to open just before the piston reaches its inserted end position and is adapted to close just after the piston has left its inserted end position.

* * * * *